US007810431B2

(12) United States Patent
Heine et al.

(10) Patent No.: US 7,810,431 B2
(45) Date of Patent: Oct. 12, 2010

(54) EXPLOSIVE CHARGE

(75) Inventors: Andreas Heine, Freiburg (DE); Matthias Wickert, Freiburg (DE); Klaus Thoma, Müllheim (DE)

(73) Assignee: Fraunhofer-Gesellschaft zur Förderung der Angewandten Forschung E.V., Munich (DE)

( * ) Notice: Subject to any disclaimer, the term of this patent is extended or adjusted under 35 U.S.C. 154(b) by 0 days.

(21) Appl. No.: 12/258,662

(22) Filed: Oct. 27, 2008

(65) Prior Publication Data

US 2009/0114111 A1 May 7, 2009

(30) Foreign Application Priority Data

Oct. 26, 2007 (DE) ..... 10 2007 051 345

(51) Int. Cl.
*F42B 1/032* (2006.01)

(52) U.S. Cl. ..... 102/307; 102/476

(58) Field of Classification Search ..... 102/307, 102/476

See application file for complete search history.

(56) References Cited

U.S. PATENT DOCUMENTS

| | | | | |
|---|---|---|---|---|
| 4,170,940 | A * | 10/1979 | Precoul | 102/476 |
| 4,860,655 | A | 8/1989 | Chawla | |
| 5,859,383 | A * | 1/1999 | Davison et al. | 102/307 |
| H2039 | H * | 8/2002 | Holt et al. | 102/307 |
| 6,868,791 | B1 * | 3/2005 | Thompson et al. | 102/476 |
| 2003/0183113 | A1 * | 10/2003 | Barlow et al. | 102/476 |
| 2007/0056462 | A1 * | 3/2007 | Bates et al. | 102/476 |

FOREIGN PATENT DOCUMENTS

| | | | |
|---|---|---|---|
| DE | 29 13 103 | C2 | 1/1980 |
| DE | 33 36 516 | A1 | 5/1985 |
| DE | 34 05 527 | C1 | 6/1985 |
| DE | 31 17 091 | C2 | 1/1987 |
| DE | 37 39 683 | C2 | 6/1989 |
| DE | 39 41 245 | A1 | 6/1991 |
| DE | 35 44 529 | C1 | 12/1994 |
| DE | 11 2005 000 960 | T5 | 3/2007 |
| GB | 2 394 763 | A | 5/2004 |
| WO | WO 2006/054081 | A1 | 5/2006 |

OTHER PUBLICATIONS

Schraml et al, Stephen J., "Effects of Initiator Position on Near-Field Blast from Cylindrical Charges", conference article on Military Aspects of Blast and Shock (MABS) 17, Las Vegas, Nevada, USA (2002), pp. 1-10.

Manfred Held, "Impulse Method for the Blast Contour of Cylindrical High Explosive Charges", Propellants, Explosives, Pyrotechnics 24, pp. 17-26 (1999).

* cited by examiner

*Primary Examiner*—Stephen M Johnson
(74) *Attorney, Agent, or Firm*—Antonelli, Terry, Stout & Kraus, LLP

(57) ABSTRACT

An explosive charge is disclosed which has a spatial shape comprising explosive material and, in the course of the explosion, unfolds a spatially anisotropic pressure action in at least one main action direction, in which the pressure action is greater than in the other action directions. The spatial shape comprising the explosive material has a surface area facing toward the at least one main action direction and extends in the at least one main action direction, particles are applied and/or a material layer disintegrating into particles during the explosion is applied to the surface area, the particles comprise a nonexplosive material, and a total mass of the particles is less than a mass of the explosive material.

19 Claims, 4 Drawing Sheets

EXPLOSIVE CHARGE

BACKGROUND OF THE INVENTION

1. Field of the Invention

The invention relates to an explosive charge which has a spatial shape comprising explosive material and which, in the course of the explosion, unfolds a spatially anisotropic pressure action in at least one main action direction, in which the pressure action is greater than in other directions.

2. Description of the Prior Art

A detonation of explosive generates, as a function of the quantity, configuration, and composition of the explosive, a strong pressure action in the environment of the location at which the detonation occurs. The pressure action is typically based on a chemical reaction of the explosive to form gaseous reaction products, the so-called vapors, which propagate at high velocities and at high temperature and density because of the large pressure differential to the environment. A propagating pressure wave is also generated in the surrounding air by the expanding vapors, which typically rushes ahead of the reaction products.

The occurrence of the pressure action may be illustrated on the example of the detonation of a spherical explosive, a so-called spherical charge. As a result of ignition of the spherical charge from the center and subsequent detonation, an air pressure wave and the vapors propagate uniformly in all spatial directions starting from the center of the detonation, that is, isotropically, the temperature of the reaction products, that is, the vapors, decreasing with increasing distance from the center. The pressure action of the vapors also decreases strongly with increasing distance from the location of the detonation.

FIGS. 2*a* and *b* show diagrams of two snapshots in regard to the pressure propagation during the explosion of a spherical charge. The diagrams each show the spatial pressure profile at the instant of the snapshot. Pressure values are plotted along the ordinates of the diagrams and distance values to the location of the explosion, scaled in charge radii of the spherical charge, are plotted along the abscissas. FIG. 2*a* shows the pressure action in the so-called near field, that is, in a distance range from the explosion location of only a few charge radii at an early instant, where a large contribution of the vapor flow to the pressure action is provided. The pressure value scaling in units of kilobars may be seen. The total pressure action in the distances of 1-2 charge radii discussed in FIG. 2*a* is caused very predominantly by the high flow pressure of the explosion vapors at the beginning of the vapor explosion.

Another image results at a later instant and thus at a greater distance from the starting point of the vapor expansion: with spherical explosive charges, one typically assumes that so-called far-field-type conditions exist from a distance of approximately 15 charge radii. The drop of the maximum pressure from the near field to the far field may be four orders of magnitude, that is, a factor of 10,000, or more. The pressure action in the so-called far field is shown for this purpose in FIG. 2*b*, in which the comparatively slight action of the air pressure wave dominates, it is noted that the scaling of the pressure values in bar, and the vapor flow hardly still contributes to the pressure action. The steep flanks recognizable in FIG. 2*b* at 9 charge radii distance characterize the front of the air pressure wave which runs ahead of the vapors. The air pressure wave is distinguished in particular by this discontinuity in the air pressure.

The pressure action thus drops very rapidly with distance for unshaped charges. If a range increase of the pressure action is desired, increasing the explosive quantity is not a suitable measure. To achieve the same maximum pressure at 10 times the distance, for example, an increase of the explosive mass by a factor of 1000 is necessary according to the scaling loss.

An array of possible implementations are known to increase the action at a predefined distance from the explosion location or to enlarge the action range without increasing the explosive quantity, in which, turning away from an isotropic action propagation, as in the spherical charge described above, the action is anisotropic. Some implementations of this type are outlined briefly hereafter:

So-called hollow charges provide sheathing of a rotationally-symmetric metal insert on one side with an explosive, which is capable upon detonation of collapsing the metal insert, which is usually implemented in the form of a thin-walled metal layer implemented as spherical or semi-spherical, longitudinally to the charge axis, which corresponds to the axis of symmetry of the metal insert. The metal insert is subsequently accelerated out of the hollow charge along the charge axis like a jet. The jet expands along the axis until finally particulation occurs. The optimum action of hollow charges, which are used in weapons for combating armored vehicles, for example, is therefore provided at short distances of a few charge diameters distance, so that a hollow charge is generally brought to the target as a warhead on a projectile and is triggered shortly before the target. A hollow charge of this type is explained, for example, in DE 31 17 091 C2, DE 33 36 516 A1, or DE 29 13 103 C2.

In an alteration of a hollow charge explained above, it is possible by extruding the cross-sectional profile of the hollow charge in a lateral dimension and by suitable material selection of the metal insert to generate a so-called linear charge, which generates a flat particle jet. See DE 37 39 683 C2, for example. Such explosive charges, which are typically referred to as cutting charges, are typically designed to cut through objects such as steel girders or armor at a short distance.

Reference is made in this context, for example, to DE 11 2005 000 960 T5, in which a single-phase tungsten alloy for a hollow charge insert is described, which has improved jet formation properties.

Furthermore, special forms of lined hollow charges are known, which are used in explosive shaped projectiles (see, for example, DE 39 41 245 A1) to form a coherent penetrator, which may fly ballistically over long distances and has a high penetrating power. Fundamentally, however, the action is like a jet or projectile for all known variants of hollow charges because of the metal insert typical for hollow charges.

Capsules which at least partially sheath the explosive quantity, made of metal, for example, are also known, which are broken into arbitrary or predefined fragments by the detonation. The energy released in the near field, that is, in the immediate surroundings of the explosive, is partially exploited to accelerate these fragments, for example, in the form of splinters, which subsequently propagate over relatively large distances, limited by the deceleration due to aerodynamic forces, and may thus cause a destructive action at a greater distance. In general, the range of the splinters and the spatial angle range covered thereby are greater than desired.

It has been possible to show on the basis of so-called cylindrical charges, in which the explosive assumes the spatial shape of a solid cylinder, in particular in combination with a suitable selection of the initiation points triggering the ignition on the explosive charge, that the pressure action may be increased or decreased in specific spatial directions. As shown by Schraml et al., "Effects of initiator position on near-field blast from cylindrical charges", conference article on Military Aspects of Blast and Shock (MABS) 17, Las Vegas, Nev., USA (2002), for example, by the simultaneous ignition at the center points of the end surfaces of a cylindrical charge, an amplified pressure action may occur in the center-point plane perpendicular to the cylinder axis. In the best case, the propagation direction of the pressure action in the near field is limited to a two-dimensional disk in an idealized approximation. However, even with cylindrical charges it is to be assumed that from a relatively short distance, only far-field-type conditions still exist, in which the pressure action due to the vapors and/or the reaction products is slight, and it is solely dominated by the air pressure wave. The anisotropy of the pressure action in particular also decreases strongly with growing distance from the charge. See, for example: M. Held "Impulse Method for the Blast Contour of Cylindrical High Explosive Charges", Propellants, Explosives, Pyrotechnics 24, 17-26 (1999) in this regard.

A further possibility for directed pressure increase is the use of solid dams which suppress the propagation of the explosion vapors in specific directions. However, this is connected with a significant growth of the total mass in a technical device, which is not acceptable for specific applications, in particular in cases in which the mass of the dam must be significantly greater than the explosive mass.

SUMMARY OF THE INVENTION

The invention is based on refining an explosive charge which has a spatial shape comprising explosive material and, in the course of the explosion, unfolds a spatially anisotropic pressure action in at least one main action direction, in which the pressure action is greater than in other action directions, as is the case in the cylindrical charge explained above, for example, in such a way that a significant improvement of the range of the pressure action and also of the spatial focusing ability of the pressure action upon the detonation is to be achieved. Thus, in particular a control of the oriented propagation of the pressure action in a sharply defined spatial direction is to be possible. Bodies or splinters propagating like a jet or projectile are expressly to be avoided, particularly because their range cannot be limited or can only be limited with great difficulty.

According to the invention, an explosive charge which has a spatial shape comprising explosive material and, in the course of the explosion, unfolds a spatially anisotropic pressure action in at least one main action direction, in which the pressure action is greater than in other action directions, is implemented in that the spatial shape comprising explosive material has a surface area facing toward the main action direction and extending in the main action direction, onto which particles are applied and/or onto which a material layer which disintegrates into particles during the explosion is applied. The particles preferably comprise non-metallic material and have a total mass assignable to the particles which is less than a mass assignable to the explosive material.

It has been recognized according to the invention that a very marked increase of the pressure action with simultaneously improved spatial focusing properties—that is, a maximum pressure action may be achieved in a very narrowly limited spatial range—may be achieved by the spatial geometric design of the spatial shape of the explosive material, without using dams known per se, which reinforce the pressure action and influence the anisotropy of the pressure action, and typically comprise solid materials. The desired goals may also be achieved without any metal inserts, which unfold known actions in this connection in the hollow charges explained at the beginning. A support structure which encloses the explosive material, for example, in the form of a capsule, is also not fundamentally required, rather the desired goals may be achieved on the basis of an intrinsically stable shaping of the explosive material. This assumes that the explosive material is suitable for implementing a stable spatial shape and has an intrinsically stable mechanical carrying capacity. In case of explosive materials which are not intrinsically spatially stable, such as gels, etc., corresponding envelopes or encapsulations which predefine the spatial shape of the explosive material are to be provided, which are in turn as detonation-neutral as possible, that is, as much as possible, they do not have effects which negatively impair the unfolding of the pressure action upon the detonation of the explosive material.

The action principle on which the focusing of the pressure action in an explosive charge implemented according to the invention is based is described on the basis of a simple possible exemplary embodiment for better illustration. It is assumed that the explosive material has a spatial shape which is plate-shaped or shell-shaped, the spatial shape referred to hereafter as a plate shape being implemented as rotationally-symmetric and thin-walled and in particular providing a concavely curved surface. Furthermore, it is assumed that an explosive charge of this type provides an ignition point for triggering and/or initiating the detonation in the area of the plate centerpoint, which is to be understood as the penetration point of the axis of symmetry of the plate shape. Immediately after the ignition event, a chemical material conversion which explosively propagates symmetrically around the ignition point along the spatial extension of the plate shape occurs, which propagates at a detonation wave velocity dependent on the selection of the explosive material. Because of the concave predefined plate shape of the explosive charge, the vapor propagation and the vapor flow connected thereto primarily occurs in the direction of the rotational axis predefined by the plate shape, which virtually extends from the concave surface area of the plate shape in a spatial direction which is identified in the further terminology as the main action direction, along which focusing of the pressure action accompanying the vapor formation results.

According to the current understanding of the spatial focusing along a spatial main action direction of the pressure action implemented upon detonation with a spatial shape of an explosive charge of this type, the vapor propagation velocity is to be adapted along the main propagation velocity in the atmosphere to the propagation velocity of the detonation in the explosive, that is, the velocity at which the chemical material conversion propagates within the explosive. The angle of inclination or opening appears to be of great significance for this purpose, at which the concavely implemented surface area extends longitudinally to the main action direction. If the concavely implemented surface shape has a very large angle of opening, that is, the plate shape is implemented as very flat, the velocity component at which the chemical material conversion propagates in the direction of the main action direction predefined by the concave shape is less than in the case of a very strongly curved plate shape. On the other hand, it is possible to predefine the vapor propagation velocity by suitable selection of the explosive material. In summary, it may therefore be stated that effective focusing of the detonation-related pressure action is to be observed if the angle of opening of the concave surface shape of a spatial shape implemented according to the invention, which comprises explosive material, and the explosive material are selected in such a way that the initial vapor propagation velocity in the main action direction and the velocity at which the material conversion of the explosive spatially propagates in this direction are identical or largely identical.

Of course, a plurality of possibilities open up for the implementation of concrete spatial shapes of this type for explosive material to implement the spatially directed focusing described above of the pressure action connected to the detonation. Thus, in addition to the above-mentioned plate-shaped or shell-shaped spatial shape, which typically provides a spherically or parabolically curved concave surface area, conical, preferably flat-conical spatial shapes are also conceivable, whose cone angle of opening essentially determines the vapor propagation velocity oriented in the main propagation direction.

The above spatial shapes are typically only provided with a single ignition point at which the initial ignition triggering occurs, which is situated in the point of symmetry of the particular spatial shape.

However, it is also fundamentally possible in comparable or differently designed spatial shapes to provide multiple ignition points or also ignition surface areas, to thus obtain sufficient vapor focusing along a main action direction. It advantageously suggests itself that a spatial shape manufactured from explosive material, which is not necessarily implemented as rotationally symmetric around an axis of rotation, be equipped with a plurality of ignition points spatially separated from one another, which are situated in an array on a surface area of the spatial shape, for example, and may be triggered individually via a corresponding ignition triggering unit. With corresponding implementation of the spatial shape of the explosive charge having a plurality of individual ignition points, a performance increase of the pressure action and also a spatial orientation of the main action direction in which the pressure action propagates may be caused by the selection of the spatially distributed ignition points and their separate triggering, without changing the spatial orientation of the spatial shape of the explosive material.

For example, it is assumed in this context that in the example described above, a spatial shape implemented as plate-shaped or shell-shaped is provided on the back of the concave surface area with a plurality of ignition points situated in an array, whose ignition triggering occurs differently from ignition triggering exclusively at the location of the symmetry center.

Thus, ignition points situated distributed around the axis of symmetry of the plate-shaped spatial shape may be ignited with a predefined specific time sequence and also with a specific predefined ignition triggering pattern, which does not necessarily provide the triggering of all existing ignition points, but rather only a selective selection of existing ignition points. In this way it is possible to vary the spatial main action direction along which focusing of the detonation-related pressure waves occur in a predefinable way without changing the orientation of the spatial shape of the explosive charge.

With the vapor focusing and/or spatial variation of the main action direction along which the maximum pressure action unfolds achieved in this way, it is necessary to perform an adaptation between the spatial configuration and the time sequence of the triggering of the ignition points and the properties of the explosive material and its spatial shape.

Furthermore, it is also conceivable, in addition to the use of only a single uniform explosive material, to implement the spatial shape, which has a specific vapor propagation velocity, to also use different explosives to implement the spatial shape. In this way, transitions using various explosive properties may be provided along the spatial shape of the explosive charge, which may certainly be used in a targeted way for the purposes of focusing of the detonation-related pressure waves.

As already briefly noted above, a nearly unlimited manifold of possible geometric spatial shapes opens up for implementing the focusing of the pressure action along a main propagation direction recognized according to the solution. In addition to plate, disk, or flat cone shapes, other charge geometries, such as double cone shapes or multiply curved surfaces, having a concave overall contour and focusing action are also conceivable.

In addition to the preceding, very significantly spatial design of the spatial shape of the explosive material and also the spatial and chronological procedure for its ignition, it has also been recognized as very essential that a further measure is to be made to obtain a significant increase of the action distance of the focused pressure action. This measure relates to providing a particle coating on at least partial areas of the concave surface area of the spatial shape. A significant increase of the pressure action at a given distance may be achieved by the particle coating, for example, in the form of individual particles or a material layer which disintegrates into particles during the explosion.

The particles particularly and expressly do not necessarily comprise metal, but rather preferably glass-like or ceramic materials.

It has been recognized according to the solution that by providing particles or a material layer which disintegrates into particles on the concavely implemented surface area, a decisive increase of the pressure action at a given distance is caused. Each individual particle will contribute to the local penetration at the impact point in the event of a possible incidence on a target structure, however, this is not the reason for increased pressure action, rather, the marked increase of the pressure action on a target structure may be traced back to the swarm behavior of all particles, the impact of the particle cloud supporting the pressure action. However, it appears to be essential that the particle cloud forming after the detonation lastingly changes the flow procedures of the explosion products. Furthermore, the total mass assignable to the particles is to be less than the mass assignable to the explosive material. The particles are therefore to be nonmetallic as much as possible, for example, comprise ceramic materials. Due to this requirement, the explosive charge according to the solution particularly differs from those explosives which use heavy metal particles for action increase, the so-called dense inert metal explosives (DIME).

The application of the particles or a material layer disintegrating into particles due to detonation on the concavely implemented surface area of the spatial shape is preferably performed using adhesively acting substances for producing an intimate connection between particles and spatial shape, which are in turn selected suitably and may thus provide a positive contribution to the overall effect.

In addition, the particle cloud may be prevented from propagating in an uncontrolled way far from the location of the detonation by the selection of the particle size and thus also the mass of the particles, as is the case, for example, with the penetrators made of conventional projectile explosive charges. The explosive charge according to the solution allows spatially extremely directed pressure action, whose action width is predefinable. The pressure action at a large distance from the location of the explosive charge may be comparable to the action of a spherical charge which is directly in contact with a target structure. It is essential that the extremely high pressure action of the explosive charge implemented according to the invention at a large distance from the charge only unfolds in a defined spatial angle range whose direction may essentially be predefined by the geometrical implementation of the spatial shape and the mode of ignition. The range of the particle cloud may be influenced by the selection of size, mass, and shape of the individual particles for a given particle total mass and explosive quantity.

BRIEF DESCRIPTION OF THE DRAWINGS

The invention is described for exemplary purposes hereafter without restriction of the general idea of the invention on the basis of exemplary embodiments with reference to the drawings. In the figures.

DETAILED DESCRIPTION OF THE INVENTION

In the explosive charge according to the invention, which finally results solely and alone through the combination of a specific predefined spatial shape made of explosive material and particles provided on a specific surface area of the spatial shape and/or a material layer which disintegrates into particles by the detonation, it is essentially important that the geometrical implementation of the spatial shape and the choice of the explosive material are selected in such a way that a chronological spatial course of the front of the propagating chemical material conversion and an accompanying resulting vapor formation through the free atmosphere which are favorable for the further propagation result as a function of the mode of ignition.

Figure 1:
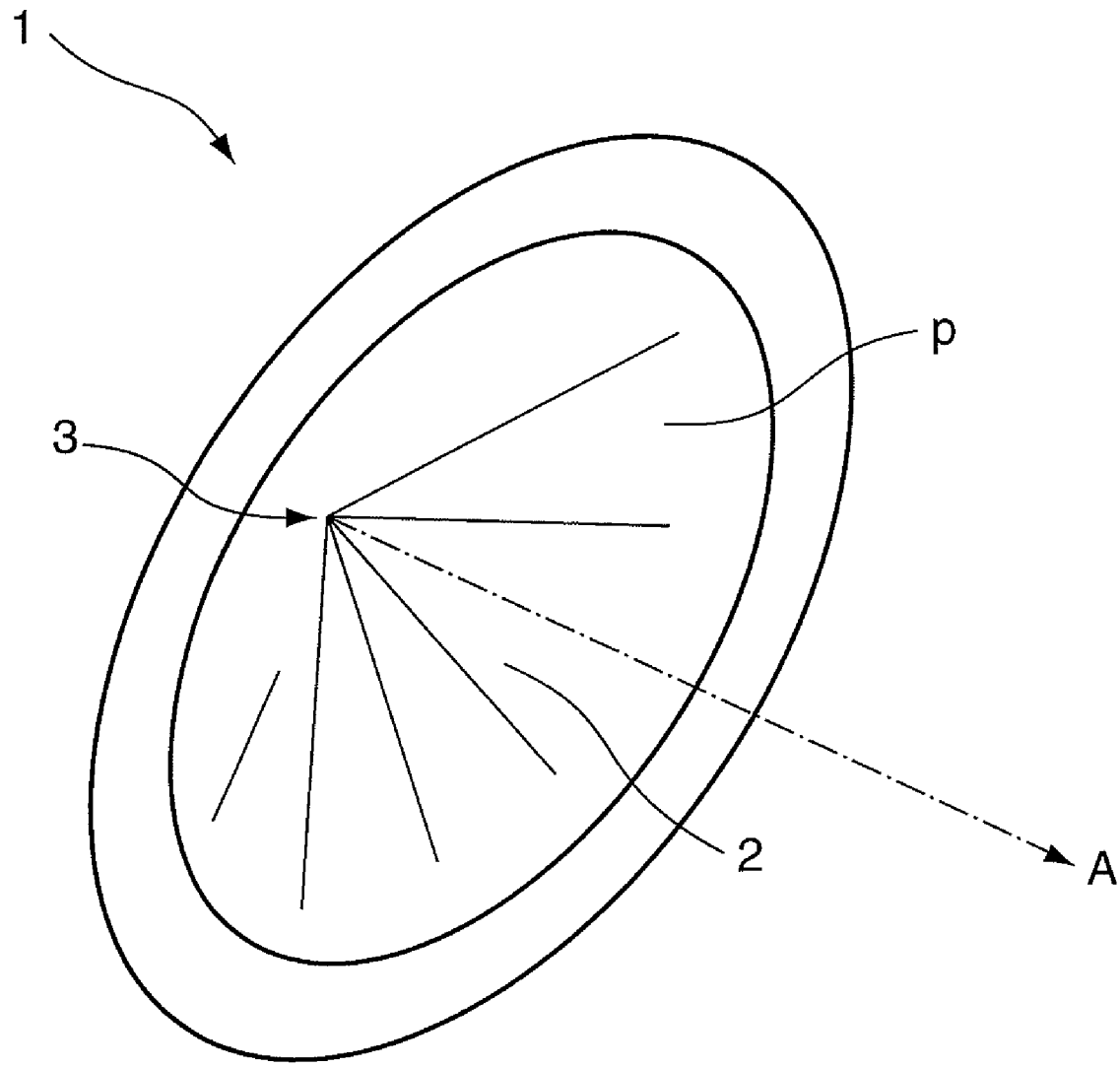
FIG. 1 shows a perspective illustration of a flat-cone explosive charge.
Figure 2A:
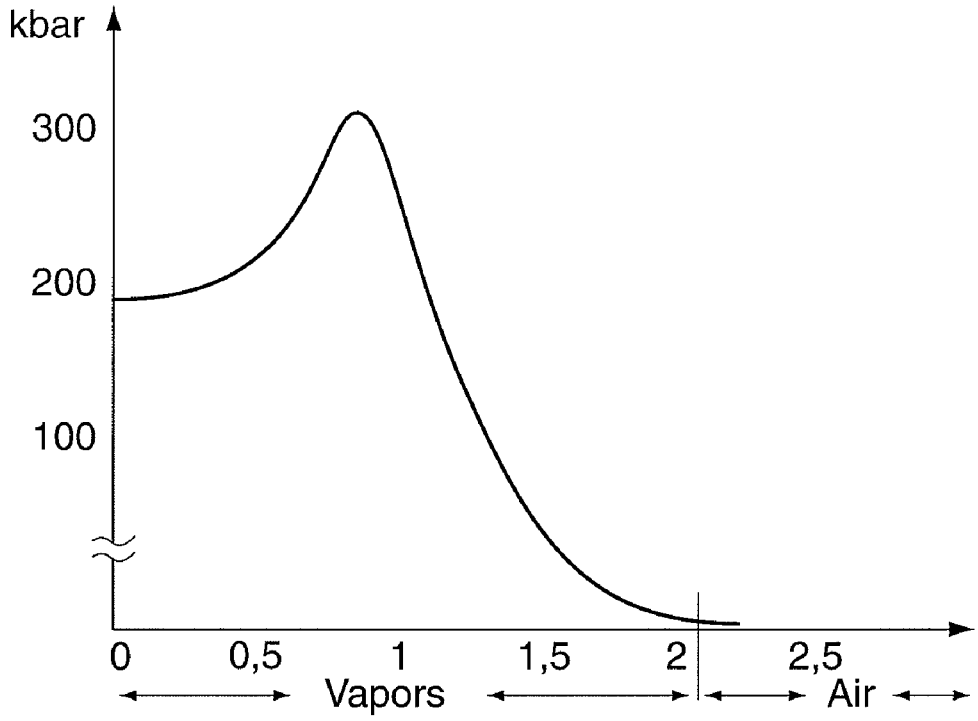
FIGS. 2*a* and *b* show diagrams to illustrate the pressure action in the near field and far field (prior art)
Figure 2B:
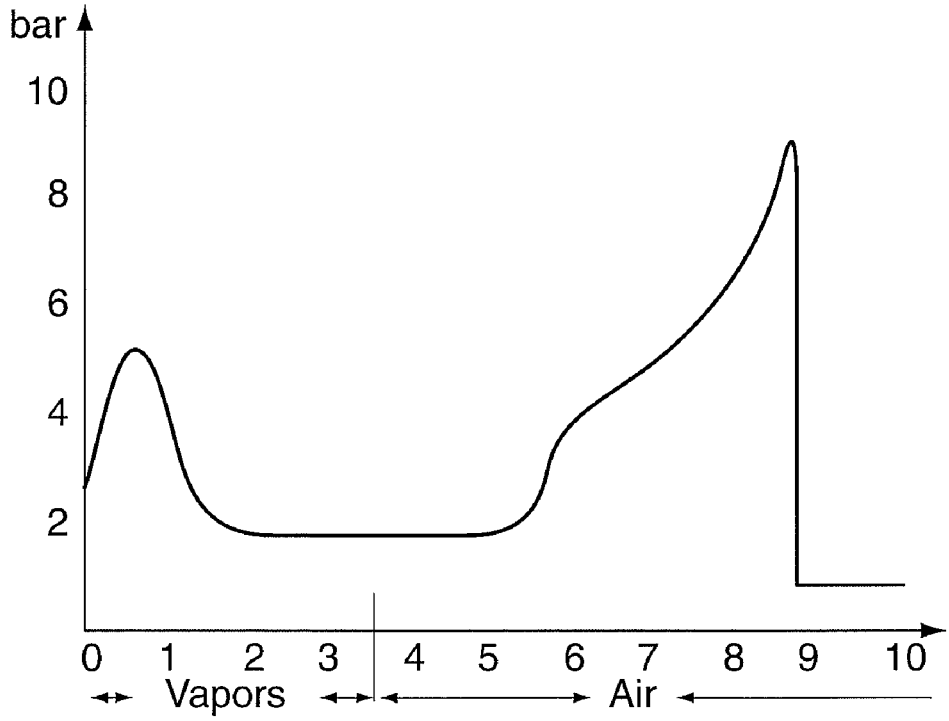

For example, the flat-cone charge shown in perspective in FIG. 1 fulfills the case of a rotationally-symmetric spatial shape oriented on a spatial point. The explosive charge 1 implemented as a flat cone has a concave surface area 2, which tapers in the plane of the drawing in a cone running together in the area of the cone tip 3 in the figure. The spatial shape is implemented as thin-walled having a wall thickness of a few millimeters to a few centimeters, depending on the selection of the flat cone diameter. It is expressly noted that no dam layers are necessarily provided on the concave surface 2 which is visible in FIG. 1 or on the rear side (not visible), which influence the detonation action of the explosive material which the flat-cone spatial shape of the explosive charge 1 comprises.

In a concrete implementation, the flat cone form provides an angle of opening of approximately 130°, pentrite (PETN) being selected as the explosive material and the ignition occurring in the center 3 of the flat cone charge, because in this case the runtime in the explosive material, which is also determined by the spatial shape, is tailored to the detonation velocity of the explosive charge.

Focusing of the pressure action implemented by the detonation of the explosive charge 1 is to be observed along the cone axis of symmetry A, along which the concave surface area 2 of the explosive charge extends expanding conically.

In addition to the special selection of the spatial shape of the explosive charge 1, a covering (not shown further) of the concavely implemented surface 2 using particles comprising nonmetallic particles, for example, in the form of glass beads or other nonmetallic particles preferably comprising ceramic materials, having a particle size down to micrometers or nanometers, contributes to drastically increasing the range of the near-field-type pressure action as a result of a directed vapor flow on the main action direction A. A drastic increase of the range of the pressure action is only achievable by providing the particles P applied to the concave surface area 2 or a corresponding material layer which disintegrates into a plurality of particles in the course of a detonation. The particles do contribute to a certain local penetration effect upon incidence on a target structure, but the drastic increase of the range of the pressure action is determined by the overall action of the system by the propagating vapor flow combined with the particulate flow of additives.

Figure 3:
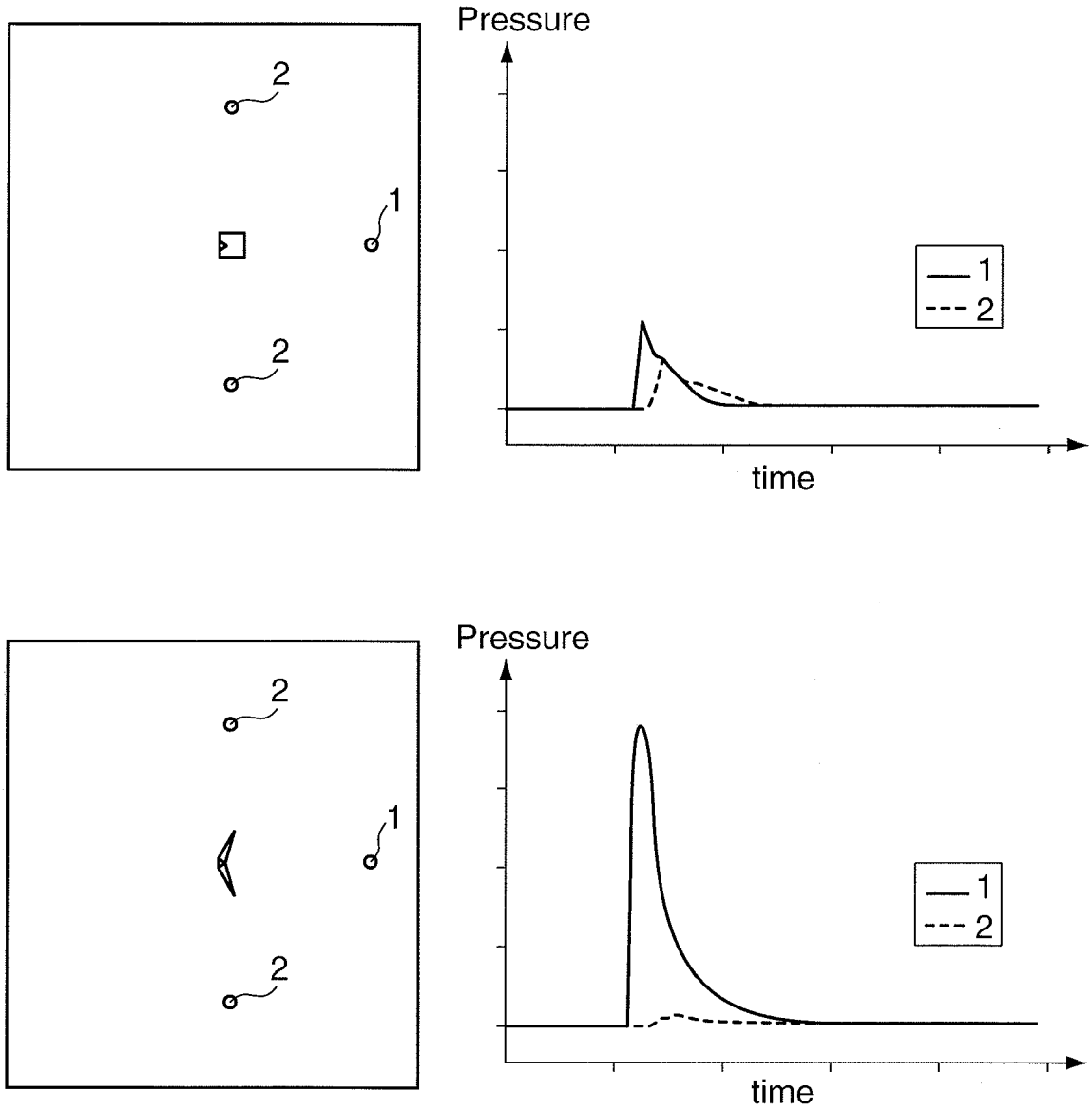
FIG. 3 shows a comparison of the pressure action of a cylindrical charge known per se to an explosive charge implemented according to the invention.

It may be seen on the basis of the illustrations shown in FIG. 3 how large the pressure differential may be between a cylindrical charge known per se according to FIG. 3 (top) and a flat cone charge having particle covering implemented according to the invention according to FIG. 3 (bottom). It is assumed that in FIG. 3 (top), left illustration in the center, the cylindrical charge is situated having horizontally running cylinder axis, which is ignited on the left side along the cylinder axis. A pressure sensor 1 is situated along the cylinder axis and two pressure sensors 2 are situated on both sides perpendicular to the cylinder axis to detect the pressure action. It may be seen on the basis of the pressure/time curve which is shown separately for sensors 1 and 2 in the diagram that a slightly increased pressure action (see graph number 1) results along the cylinder axis in comparison to the pressure action detected by sensors 2. An identical situation in regard to the pressure action to be detected is shown in FIG. 3 (bottom), however, in this case a flat cone charge having a single ignition point attached to the tip of the flat cone charge is caused to detonate. The pressure actions are again shown separately for the sensor 1 along the flat cone axis and the sensors 2 in the adjacent diagram. The much greater pressure action along the main action direction at equal distance in comparison to the example in FIG. 3 (top) is clearly visible. In addition, the pronounced pressure differential between the sensors 1 and 2 in FIG. 3 (bottom) is to be noted.

An alternative spatial shape for the design of an explosive charge 1 is shown in perspective from various view angles in FIGS. 4*a* through *e*.

Figure 4A:
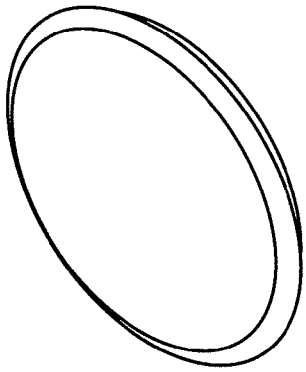
FIGS. 4*a-e* show views from multiple sides of an explosive charge implemented having a shell-shaped spatial shape for an embodiment of an explosive charge implemented according to the invention having two or more ignition points.
Figure 4B:
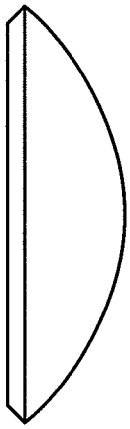
Figure 4D:
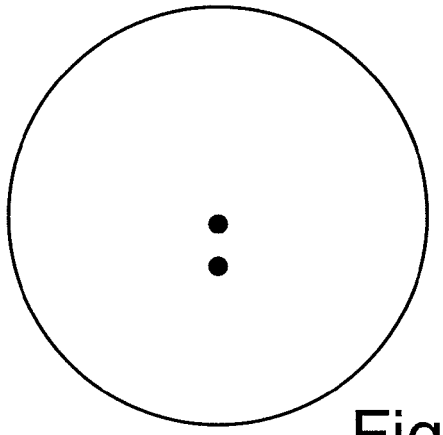

In this case, the explosive charge 1 has a shell-shaped or cap-shaped spatial shape, which has a spherically molded surface area 2 according to FIG. 4*a*. It is also obvious on the basis of FIG. 4*b*, which shows a side view of the explosive charge, that dam layers are not provided on the concave front side or on the rear side. The axis shown indicates the main action direction A, in case of ignition of the explosive charge at the ignition point Z 1, which is penetrated by the axis of symmetry, which is the equivalent to the main action direction A.

Figure 4C:
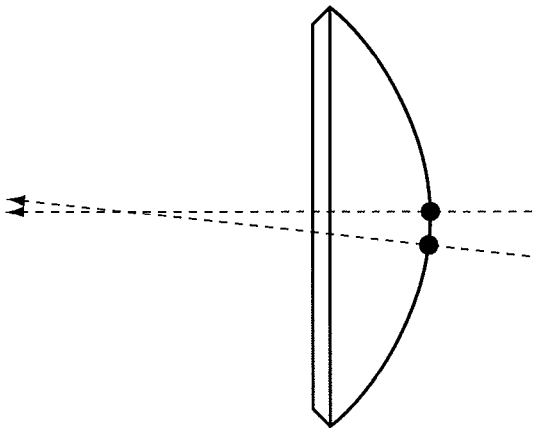

The same cap-shaped explosive charge 1 is shown in each of FIGS. 4*c* and *d*, but now having two ignition points Z1 and Z2. As already noted above, an ignition of the explosive charge 1 at the ignition point Z1 would cause a pressure action implemented focused along the axis A1. In contrast, if the same explosive charge, without pivoting it in space, was initially ignited at the point Z2, a second main action direction A2 pivoted around the main action direction A1 results, along which the pressure action propagates focused. It may thus be shown that by a specific displacement of the ignition point to the spatial shape of the explosive charge, the spatial direction along which the pressure action propagates focused may be pivoted.

Figure 4E:
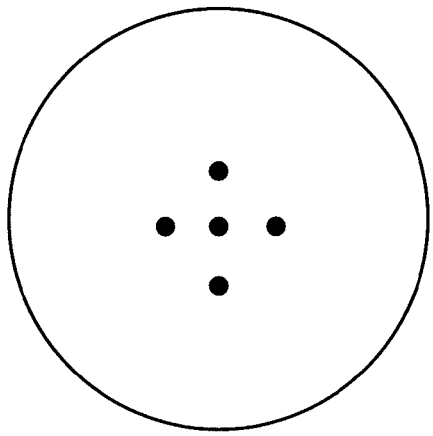

FIG. 4*e* shows an arrayed configuration of five ignition points Z1 through Z5, which are applied distributed on the backside of the shell-shaped spatial shape of the explosive charge 1. The individual ignition points Z1 through Z5 may be triggered individually, separately, or in combination using a corresponding ignition triggering unit. It has thus already been able to be proved experimentally that it is possible to control the main action direction along which the pressure action propagates focused by variation of the location of the ignition points.

Successful experiments have already been performed using an explosive charge according to the invention, using which it was able to be demonstrated that steel plates which were situated at distances of up to 5 m from the location of the explosive charge could be caused to burst open because of intensive short-term pressure action. If the explosive charge implemented according to the invention was spaced only 1 m from the steel plate, the damage picture forming on the steel plate was similar to the damage which a spherical charge of equal explosive mass causes in direct contact to the steel plate. This illustrates the much higher pressure action potential of the explosive charge according to the invention in relation to typical spherical charges, for example.

The near-field-type pressure action of the vapor flow may provably be transmitted over a very long distance using the measures according to the invention, compared to the dimensions of the near field of a typical spherical charge of equal mass. The measures required for this purpose take the aspect of a technically simple and cost-effective implementation into consideration in particular and may additionally be implemented at lower weight. The increase of the pressure action is concurrently not based, as in the comparable known achievements up to this point, on projectile-like properties or splinter effects, because projectiles or splinters fly further along their flight path over large distances, while the pressure action of charges which are designed according to the above principle is effectively settable in the range of the pressure action and thus may be limited. Endangerment by flying splinters may thus be effectively prevented.

The explosive charge according to the solution may be used by manifold scientific purposes, in technical methods, and apparatus, for example, by accelerating objects or reshaping materials.

LIST OF REFERENCE NUMERALS

1 explosive charge
2 concave surface area
3 cone tip
P particle
Z ignition point
A main action direction

The invention claimed is:

1. An explosive charge, which has a spatial shape comprising:

explosive material which in the course of an explosion, provides a pressure action in at least one main action direction in which the pressure action is greater than in other directions; and wherein the spatial shape comprises explosive material with a surface area facing toward the at least one main action direction and extending in the at least one main action direction and nanoparticles or microparticles applied to the surface area and/or a material layer applied to the surface area which disintegrates into the nanoparticles or microparticles during the explosion and the nanoparticles or microparticles propagating without the formation of a jet or projectile with a total mass of the particles being less than a total mass of the explosive material.

2. The explosive charge according to claim 1, wherein:

the spatial shape of the explosive material has a hollow geometry and the surface area is concave on which the particles are applied at least sectionally and/or the material layer disintegrating into particles during the explosion is applied at least sectionally.

3. The explosive charge according to claim 1, wherein:

particles are also introduced into a volume of the explosive material.

4. The explosive charge according to claim 1, wherein:

the particles comprise nonmetallic material.

5. The explosive charge according to claim 1, wherein:

the spatial shape of the explosive material provides at least one area at which an igniter is provided for triggering the explosion; and the location of the at least one ignition point in relation to the spatial shape and the spatial shape of the explosive material provides a material conversion of the explosive material during the explosion having a propagation velocity component oriented in the at least one main action direction which corresponds to a vapor propagation velocity propagating in the at least one main action direction along which the pressure action propagates.

6. The explosive charge according to claim 5, wherein:

the explosive material comprises pentrite and a flat cone with a cone angle between 125° and 135° .

7. The explosive charge according to claim 1, wherein:

the spatial shape of the explosive material is stable and no components are provided having spatial guiding effects on the explosion related to the pressure action propagating along the at least one main direction.

8. The explosive charge according to claim 7, wherein:

the spatial shape is a flat cone with a tip and a flat cone funnel expanding conically in the direction of the at least one action direction, the flat cone funnel having the particles disposed therein and/or the material layer is provided on the cone funnel.

9. The explosive charge according to claim 8, wherein:

the igniter is provided in an area of the tip.

10. The explosive charge according to claim 9, wherein:

the spatial shape is freely accessible from a concave side and from a convex side of the flat cone.

11. The explosive charge according to claim 8, wherein:

the flat cone has a wall thickness ranging from 1 mm to at least a centimeter.

12. The explosive charge according to claim 8, wherein:

the flat cone encloses a cone angle which ranges between greater than 90° and less than 180° .

13. The explosive charge according to claim 1, wherein:

the spatial shape is concave and expands radially relative to the at least one main action direction.

14. The explosive charge according to claim 13, wherein:

the concave surface area is rotationally symmetric.

15. The explosive charge according to claim 1, wherein:

the spatial shape of the explosive charge includes at least two ignition points spatially separated from one another, which are connected to an ignition triggering unit, providing triggering in a predefinable time sequence; and the at least two ignition points are attached to the explosive charge and selection of a time sequence of ignition of the at least two ignition points is determined by a desired anisotropy of the pressure action.

16. The explosive charge according to claim 15, wherein:

the ignition points are in an array, which are connected by the ignition triggering unit, and are triggered in a predefinable time sequence and a spatial ignition sequence; and a location of the attachment of the ignition points to the explosive charge and/or the selection of the time sequence and/or the spatial ignition sequence for the ignition is determined by the desired anisotropy of the pressure action.

17. The explosive charge according to claim 1, wherein:

the spatial shape of the explosive charge focuses or concentrates the pressure action on a spatial point, a line, or along a surface.

18. The explosive charge according to claim 1, wherein:

the spatial shape comprises areas comprising different explosive materials.

19. The explosive charge according to claim 1, wherein:

the particles applied to the surface area are divided into at least two particle groups each having different sizes and/or particle materials and/or the material layer applied to the surface area has at least two areas having different layer materials.

* * * * *